US006933056B2

(12) United States Patent
Mathew

(10) Patent No.: US 6,933,056 B2
(45) Date of Patent: Aug. 23, 2005

(54) EXHAUST MANIFOLD AND METHOD OF MAKING THE SAME

(75) Inventor: Boney A. Mathew, Clarkston, MI (US)

(73) Assignee: Mathson Industries, Troy, MI (US)

( * ) Notice: Subject to any disclaimer, the term of this patent is extended or adjusted under 35 U.S.C. 154(b) by 42 days.

(21) Appl. No.: 10/294,381

(22) Filed: Nov. 14, 2002

(65) Prior Publication Data

US 2003/0091455 A1 May 15, 2003

Related U.S. Application Data

(60) Provisional application No. 60/335,995, filed on Nov. 15, 2001.

(51) Int. Cl.[7] ..... B22F 7/02
(52) U.S. Cl. ..... 428/552; 419/5; 60/323
(58) Field of Search ..... 428/552; 419/5, 419/36; 60/323; 75/230

(56) References Cited

U.S. PATENT DOCUMENTS

| | | | | | |
|---|---|---|---|---|---|
| 3,798,903 | A | * | 3/1974 | Mitchell et al. | 60/282 |
| 4,264,660 | A | * | 4/1981 | Siebels | 428/34.5 |
| 4,376,374 | A | * | 3/1983 | Bothwell | 60/687 |
| 5,018,661 | A | | 5/1991 | Cyb | 228/176 |
| 5,066,626 | A | * | 11/1991 | Fukao et al. | 501/128 |
| 5,142,863 | A | * | 9/1992 | Ushio et al. | 60/272 |
| 5,169,578 | A | * | 12/1992 | Fukao | 264/637 |
| 5,223,213 | A | | 6/1993 | Kamimura et al. | 419/35 |
| 5,419,127 | A | | 5/1995 | Moore, III | 60/322 |
| 5,682,741 | A | | 11/1997 | Augustin et al. | 60/323 |
| 5,746,957 | A | * | 5/1998 | Fanelli et al. | 264/109 |
| 5,964,273 | A | * | 10/1999 | Strasser et al. | 164/98 |
| 6,056,915 | A | | 5/2000 | Behi et al. | 419/6 |

FOREIGN PATENT DOCUMENTS

EP 0595075 A2 * 4/1994 ..... B32B/18/00

* cited by examiner

*Primary Examiner*—Daniel Jenkins
(74) *Attorney, Agent, or Firm*—Howard & Howard

(57) ABSTRACT

An exhaust manifold (10) of the present invention comprises a liner (12) that includes inner surface (14) defining manifold passages and an outer surface (16). The exhaust manifold (10) includes a shell (18) of a homogeneous and continuous material disposed over the outer surface (16) of the liner (12). The shell (18) and liner (12) of the exhaust manifold (10) include first (60) and second (72) composition formed from ferrous and non-ferrous metal powders (62), ceramic powder (64), and a binder (74) added thereto to form the manifold (10). The invention discloses a method of making the exhaust manifold (80). Accordingly, the exhaust manifold (10) of the subject invention has a reduced weight and dissipates heat energy contained in the exhaust thereby increasing the efficiency of the catalytic converter (42).

51 Claims, 4 Drawing Sheets

FIG - 1
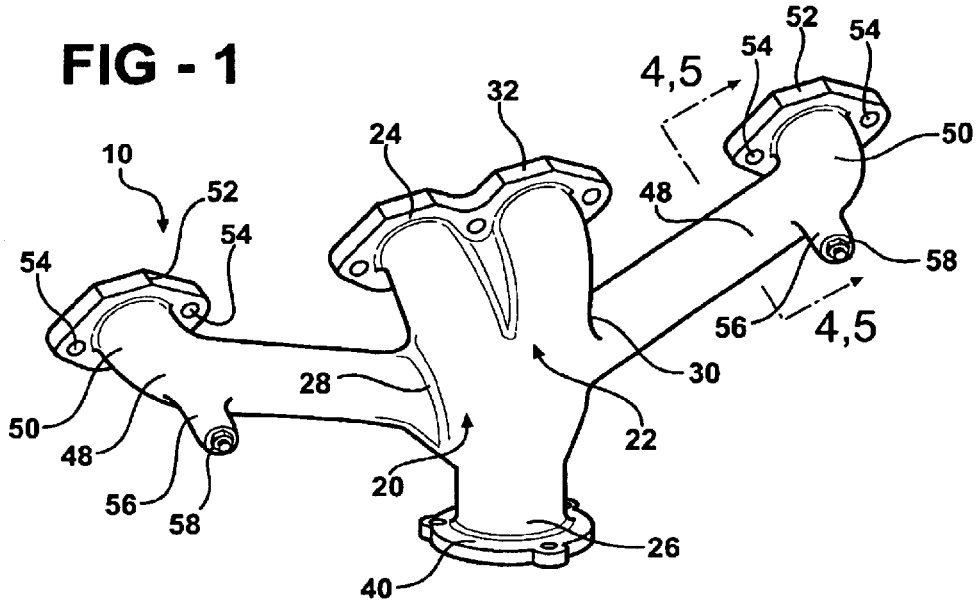
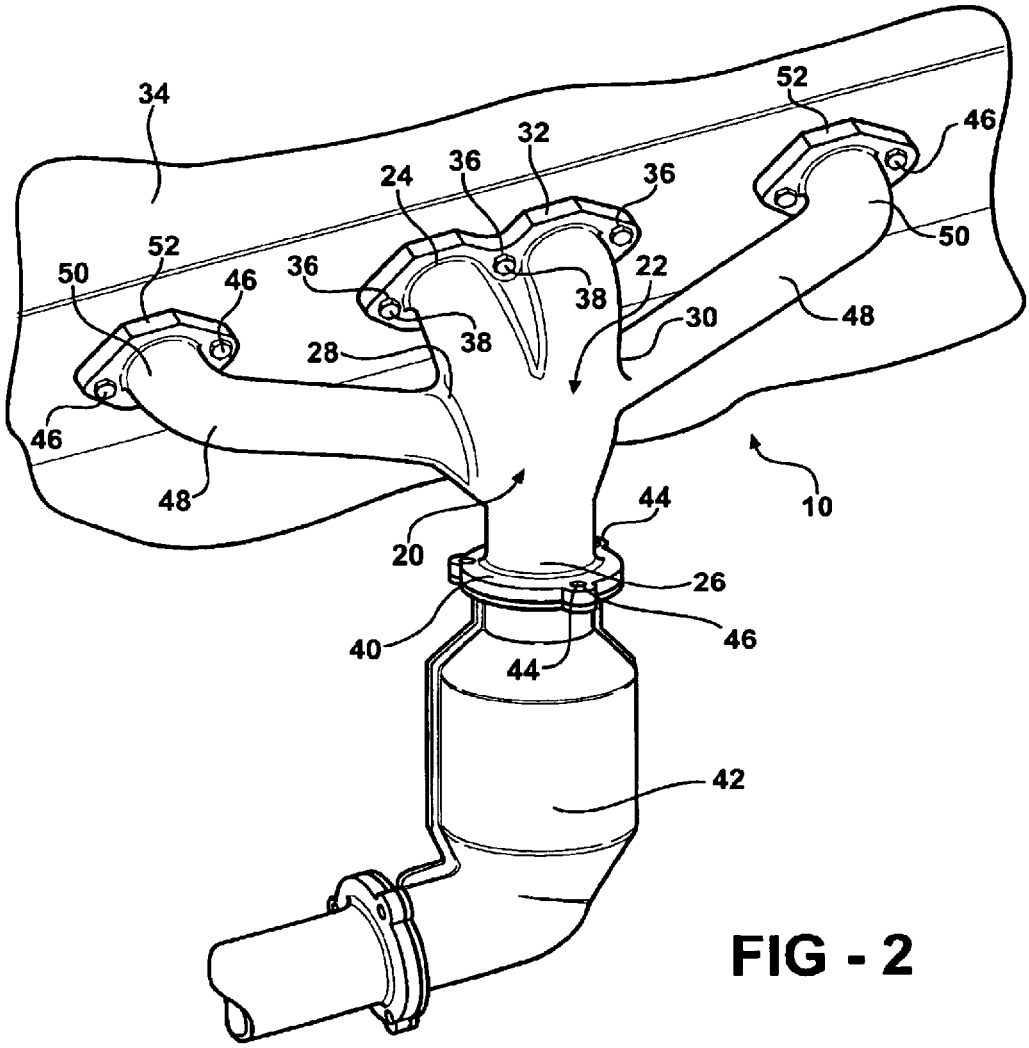
FIG - 2

EXHAUST MANIFOLD AND METHOD OF MAKING THE SAME

The present application claims priority to U.S. Provisional Patent Application No. 60/335,995 filed on Nov. 15, 2001.

BACKGROUND OF THE INVENTION

1. Field of the Invention

The subject invention relates to an injection molding exhaust manifold having a ceramic liner and method of making the same.

2. Description of the Prior Art

Generally, catalytic converters used in the automotive industry, are usually heated by the engine exhaust gases. It is critically important to minimize the amount of a residual heat of the exhaust gases of an internal combustion engine to provide for highly efficient and effective catalytic converter that may reduce the emission levels of the engine.

Numerous, techniques for insulating exhaust manifolds and for providing other means to speed up light off have been suggested and known in the automotive industry today. One of the techniques known is a cast iron molding, disclosed in the U.S. Pat. No. 5,018,661 to Cyb, that shows a cast manifold comprising first and second sections cast in place from a metal to form a housing of the manifold. Hence, cast molded exhaust manifolds are heavy and increase the overall weight of the vehicle. The U.S. Pat. No. 5,682,741 to Augustin et al. and U.S. Pat. No. 5,419,127 to Moore, III show a welded tubing exhaust manifolds that have less mass, but are complicated and expensive to manufacture. Additionally, a double-walled welded tubing exhaust manifolds have been suggested, with an air gap between the walls, as shown in the Moore Patent cited above. Hence, double-walled exhaust manifold may be not cost effective, they are still complex to manufacture.

The related art also provides for other examples of exhaust manifolds being cast molded from a liquid metal having ceramic particles for use on vehicles. One such example is shown in U.S. Pat. No. 5,223,213 to Kamimura et al. The Kamimura Patent discloses an exhaust manifold having ceramic particles integrally formed within the exhaust manifold. However, the liquid metal used for casting the exhaust manifold may include defects, which reduces the strength of the exhaust manifold.

The approaches disclosed in the prior art patents, cited above, are expensive and add weight. Injection molding is a preferred process for manufacturing complex shaped parts from metal and ceramic powders. One such method is shown in U.S. Pat. No. 6,056,915 to Behi et al. The Behi Patent discloses method of making tools from injection molding procedures and includes the steps of inserting a mold into an injection molding apparatus, injecting powder metal feedstock into the mold, debinding the part for forming a green body, and sintering the part to form a completed part. However, the Behi Patent does not allow for multiple components to be combined into a single unitary piece.

Although the prior art patents disclose different designs of exhaust manifolds and methods of making the same, one of the opportunities of continuous development and research is the area of a more advanced design of an exhaust manifold and process of making the same that may provide for additional weight reduction and dissipation of heat energy contained in the exhaust thereby increasing the efficiency of the catalytic converter, and reduction of the manufacturing cost of the catalytic converter since the size of the catalytic converter may be reduced with increased efficiency. Still another area of continuous development and research is the area of a manifold design that may eliminate seams on the outer shell wherein the liner or insert is encapsulated by the outer shell continuously extending about the liner.

BRIEF SUMMARY OF INVENTION

An exhaust manifold comprises a liner that includes inner surface defining manifold passages and an outer surface. The exhaust manifold includes a shell of a homogeneous and continuous material formed from a metal powder and a ceramic powder and disposed over the outer surface of the liner, which includes a second homogeneous and continuous material formed from a metal powder and a ceramic powder. The invention discloses a method of making the exhaust manifold that comprises the steps of forming the liner that includes inner surface defining manifold passages and the outer surface, molding the shell of homogeneous and continuous material completely encapsulating the outer surface of the liner. The method further included the step of adding a binder to the homogeneous and continuous material and pelletizing the homogeneous and continuous material to form a feedstock wherein the homogeneous material is extruded through the extruder to form the feedstock.

Accordingly, the exhaust manifold of the subject invention has a reduced weight and dissipates heat energy contained in the exhaust thereby increasing the efficiency of the catalytic converter. Additionally, the method of the present invention provides for seam-free outer shell of the manifold.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of an exhaust manifold;

FIG. 2 is a perspective view of the exhaust manifold combined with a catalytic converter;

DETAILED DESCRIPTION OF THE INVENTION

Figure 3:
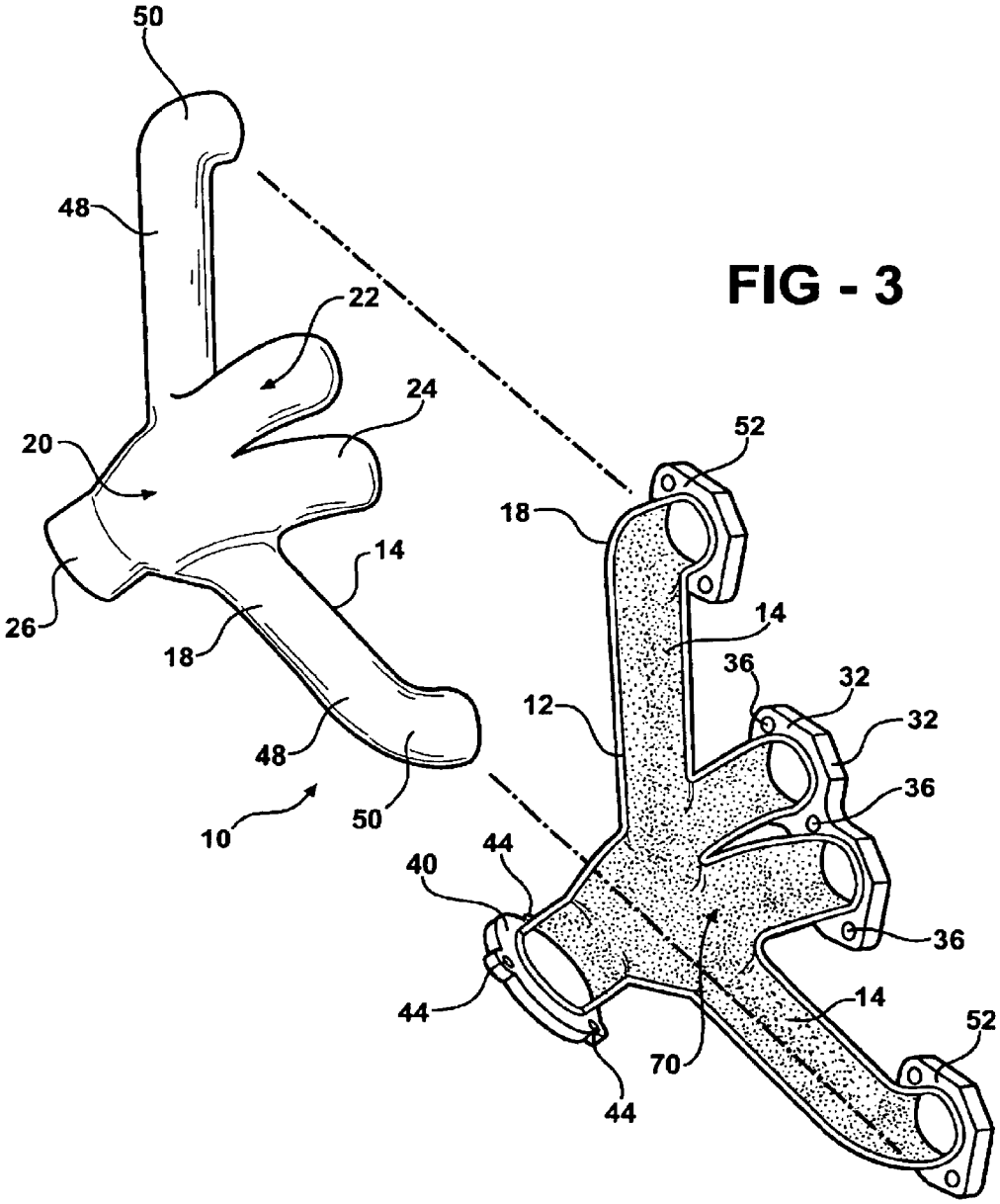
FIG. 3 is a perspective cut away view of the exhaust manifold.

Referring to the FIGS. 1 through 5, wherein like numerals indicate like or corresponding part throughout the several views, an exhaust manifold for an internal combustion engine, is generally shown at 10. The exhaust manifold 10 comprises a liner 12 that includes inner surface 14 defining manifold passages and an outlet surface 16. The exhaust manifold 10 includes a shell 18 of a homogeneous and continuous material disposed over the outer surface 16 of the liner 12.

The exhaust manifold 10 includes a housing, generally indicated at 20, defined by the shell 18 and the liner 12. The housing 20 includes a central portion, generally indicated at 22, having inlet 24 and outlet 26 ends and side walls 28, 30.

The inlet end 24 of the central portion 22 includes an inlet flange 32 extending therefrom for mounting the exhaust manifold 10 to a surface of an engine 34. The inlet flange 32 includes at least one aperture 36 therewithin to receive a male connector 38 to engage the inlet flange 32 with the surface of the engine 34. The outlet end 26 of the central portion 22 includes an outlet flange 40 extending therefrom for mounting the exhaust manifold 10 to a catalytic converter 42. The outlet flange 40 includes at least one aperture 44 therewithin to receive the male connector 46 to engage the outlet flange 40 with the catalytic converter 42.

The central portion 22 of the housing 20 includes at least one outlet portion 48 outwardly extending from the side walls 28, 30 to a distal end 50 terminating into a flange 52, which includes at least one aperture 54 therewithin to receive the male connector 46 to engage the outlet portion 48 with the engine 34. The distal end 50 of the outlet portion 48 includes a boss 56 extending outwardly therefrom wherein the boss 56 includes an aperture 58 to provide for additional connection of the exhaust manifold 10 within the engine 34.

Figure 4:
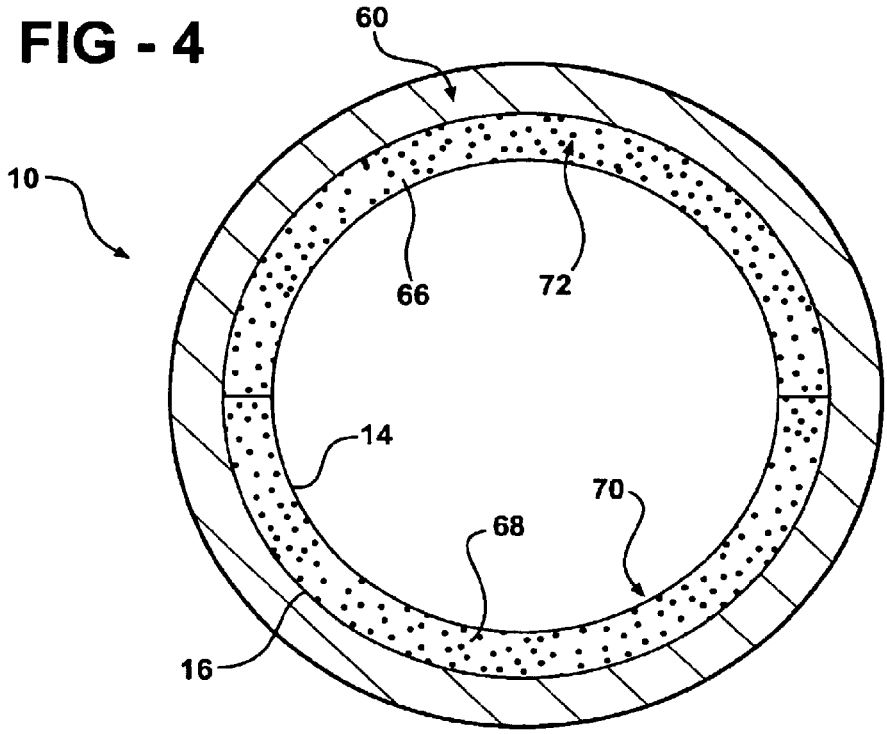
FIG. 4 is a cross-sectional view of the exhaust manifold.
Figure 5:
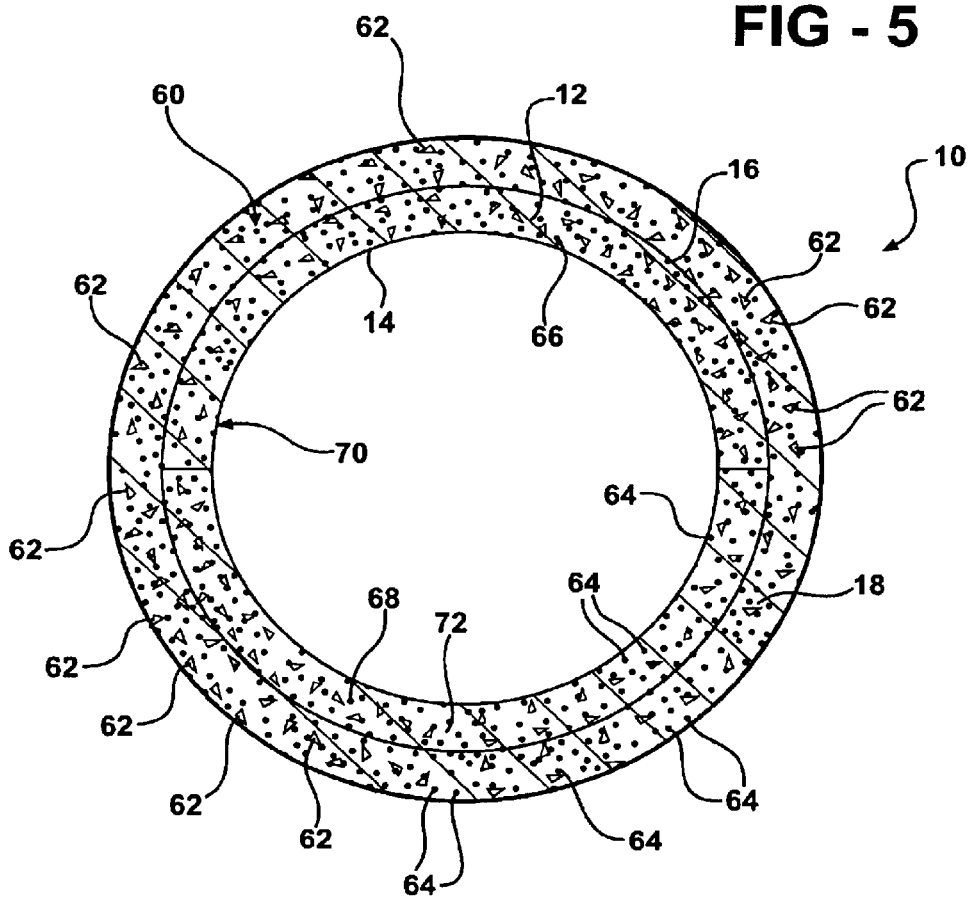
FIG. 5 is a schematic view of a method of making the exhaust manifold.

The shell 18 of the exhaust manifold 10 includes a first composition, generally indicated at 60, of the aforementioned homogeneous and continuous material, which is formed from ferrous and non-ferrous metal powders 62 and a ceramic powder 64. The ferrous and non-ferrous metal powders 62 include, but not limited to iron, brass, copper, aluminum, stainless steel, nickel, tungsten, titanium, tool steel, or mixture thereof, and the like. The ceramic powder 64 of the first composition 60 includes aluminum oxide ($Al_2O_3$), zirconia, steatite, or mixture and alloys thereof, and the like. The first composition 60 includes a binder 74 added thereto to form the shell 18. The binder 74 comprises water, an agar solution, and a gel strength-enhancing agent and may be added to the first composition 60 to increase the strength of molded manifold 10 and resist cracking upon removal of the manifold 10 from die. Preferably, the agar solution may include and not be limited to other polymers such as polypropylene, polyethylene, polystyrene, polyvinyl chloride, paraffin wax, polyethylene carbonate, polyethylene glycol, and the like. Preferably, biocides may be added to the first composition 60 to impede bacteria growth. As illustrated in FIG. 4, the first composition (76) of the shell (18) includes between 49% to 99% of the metal powder in relation to the ceramic powder and the binder.

The shell 18 is disposed continuously over and encapsulates the outer surface 16 of the liner 12 that comprises first 66 and second 68 halves defining passages, generally indicated at 70, therebetween to allow a gas flow run through the exhaust manifold 10. The liner 12 includes a second composition, generally indicated at 72, i.e. second homogeneous and continuous material, formed from the ferrous and non-ferrous metal powders 62 and a ceramic powder 64, and the binder 74 added thereto. In one embodiment of the present invention, the second composition 72 includes between 0.1% to 99.9% of the ceramic powder 64 in relation to the metal powder 62 and the binder 74. In the alternative embodiment of the present invention, the second composition 72 may include 100% of the ceramic powder 64.

Figure 6:
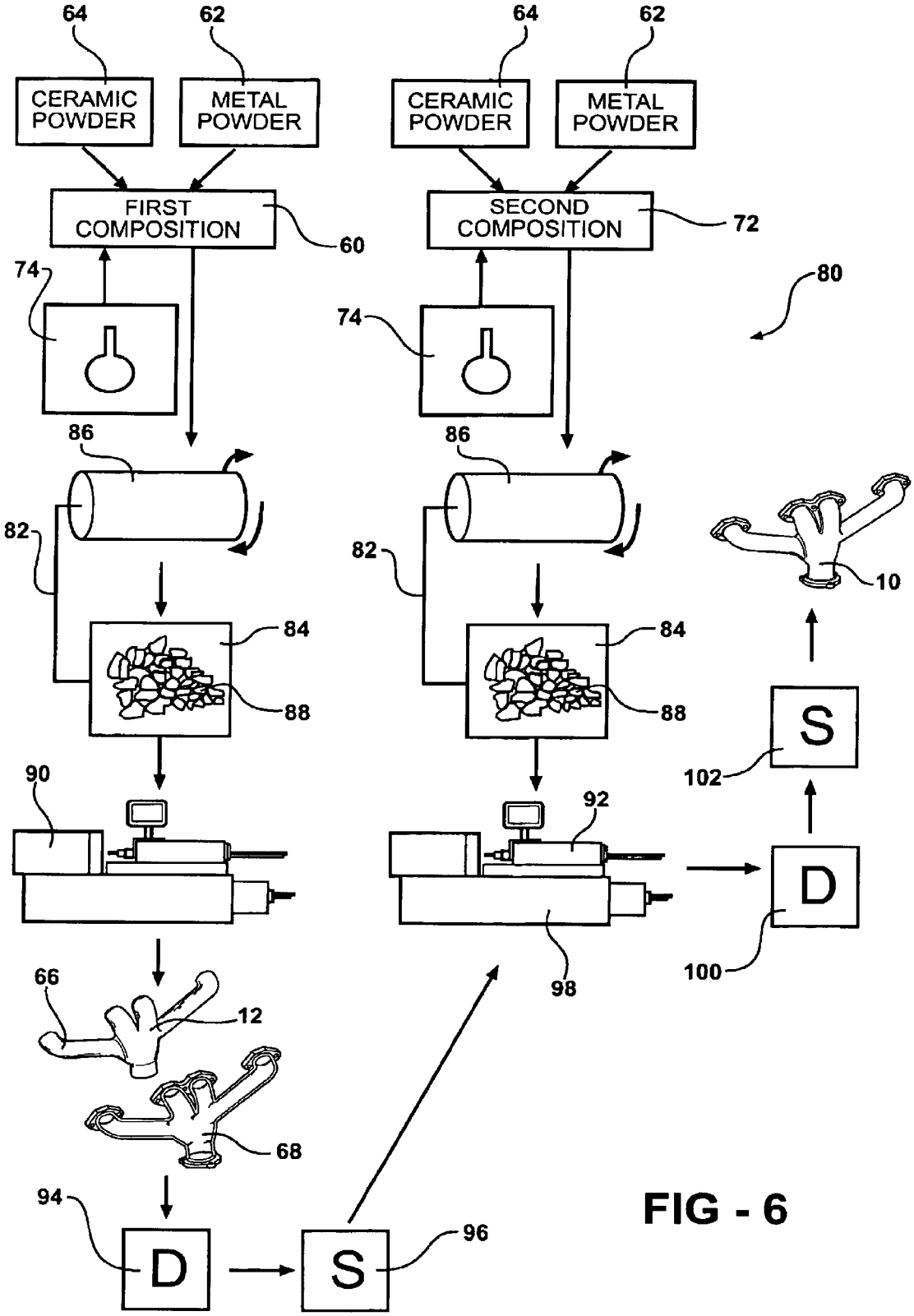
FIG. 6 is a schematic view of a method of making the exhaust manifold.

The subject invention also includes a method of making the exhaust manifold, generally shown at 80 in FIG. 6. The method 80 comprises the steps of forming the liner 12 and molding the shell 18 of a homogeneous and continuous material completely encapsulating the outer surface 16 of the liner 12.

As alluded to above the method 80 of the present invention begins with mixing the metal 62 and ceramic 64 powders to form the first 60 and second 72 compositions. The first 60 and second 72 compositions include the binder 74 added thereto, respectively, to form a homogeneous material of the first 60 and second 72 compositions.

The following step of the method 80 further includes pelletizing 82 the homogeneous material of the first 60 and second 72 compositions, respectively, to form a feedstock 84 wherein the homogeneous material is extruded through a twin barrel screw type extruder or mixture 86 to form the respective feedstock 84 and processed into pellets 88 for use in injection molding apparatus 90, 92. Based on the embodiments of the present invention, the first composition 60 may include between 0.1% to 99.9% of the metal powder 62 in relation to the ceramic powder 64. In the alternative embodiment, the first composition 60 may include 100% of the metal powder 62. The second composition 72 may include between 0.1% to 99.9% of the ceramic powder 64 in relation to the metal powder 62. In the alternative embodiment, the second composition 72 may include 100% of the ceramic powder 64.

As alluded to above the following step of the present method 80 includes forming 92 the liner 12 in two halves 66, 68 wherein the second composition 72 is injected into the injection molding apparatus 90 followed by the step of debinding 94 the halves 66, 68 of the liner 12 removed from the injection molding apparatus 90. The step of debinding 94 the liner 12 includes heating the liner 12 at the temperature between about 1200 to 1500° C. to allow portions of the binder 74 to be evaporated slowly from the liner halves 66, 68. After a predetermined period of time, the step of debinding 94 is followed by the step of sintering 96 the halves 66, 68 of the liner 12 together wherein the liner 12 is heated between about 1000 to 1650° C. Similar to the debinding 94, the sintering 96 of the liner halves 66, 68 includes putting together the liner halves 66, 68 and placing them in an oven (not shown). The oven is set at a desired temperature to sinter the liner halves 66, 68 together. The temperature of the oven depends upon the mixture of the powders 62, 64, which form the feedstock 84. Alternatively, the debinding 94 may occur at room temperature depending upon the feedstock 84.

The next step 98 of the present method 80 includes positioning the liner 12 in the mold 92 and injecting the first composition 60 continuously over the outer surface 16 of the liner 12 to form the manifold 10. Preferably, the vertical mold is used to inject the first composition 60 over the liner 12. The step of injecting 98 the first composition 60 is followed by debinding 100 the manifold 10 by heating the manifold 10 at the temperature between about 200 to 500° C. The debinding 100 of the manifold 10 is followed by sintering 102 the manifold 10 to heat the manifold 10 between about 1000 to 1500° C.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A method of making an exhaust manifold (70) comprising the steps of:

forming a liner (12) including inner surface (14) defining manifold passages and an outer surface (16);

forming a first composition (76) of ceramic powder (72) and a metal powder (74);

adding a binder (78) to said first composition (76) to form a homogeneous material;

extruding said homogeneous material through an extruder (83) to form a feedstock (82);

pelletizing (80) said homogeneous material to form a feedstock (82); and molding a shell (18) of said homogeneous and continuous material of said feedstock (82) completely encapsulating said outer surface (16) of said liner (12).

2. A method (70) as set forth in claim 1 including forming said liner (12) in two halves (60), (62).

3. A method (70) as set forth in claim 2 including forming (90) said liner (12) of a second composition (77) of said ceramic powder (72) and metal powder (74), debinding (92) and sintering (94) said halves (60), (62) of said liner (12) together.

4. A method (70) as set forth in claim 3 including adding said binder (78) to said second composition (77) to form a second homogeneous material.

5. A method (70) as set forth in claim 4 including pelletizing (80) said second homogeneous material to form a second feedstock.

6. A method (70) as set forth in claim 5 including positioning (96) said liner (12) in a mold and injecting said first composition (76) continuously over outer surface (16) of said liner (12) to form said manifold (10).

7. A method (70) as set forth in claim 6 including debinding (98) and sintering (100) said manifold (10).

8. A method (70) as set forth in claim 1 including aluminia in said first composition (76).

9. A method (70) as set forth in claim 8 including zirconia in said first composition (76).

10. A method (70) as set forth in claim 9 including steatite in said first composition (76).

11. A method (70) as set forth in claim 1 including ferrous metal powder in said first composition (76).

12. A method (70) as set forth in claim 11 including nonferrous metal powder in said first composition (76).

13. A method (70) as set forth in claim 1 wherein said binder (78) added to said composition (76) includes a water.

14. A method (70) as set forth in claim 13 wherein said binder (78) added to said composition (76) includes an agar solution.

15. A method (70) as set forth in claim 14 wherein said agar solution includes a polysaccharide derived from seaweed.

16. A method (70) as set forth in claim 15 wherein said binder (78) added to said composition (76) includes a gel strength-enhancing agent.

17. A method (70) as set forth in claim 16 wherein said gel strength-enhancing agent has a form of a borate compound to form said feedstock pellets (84).

18. A method (70) as set forth in claim 16 wherein said borate compound includes calcium borate.

19. A method (70) as set forth in claim 18 wherein said borate compound includes zinc borate.

20. A method (70) as set forth in claim 19 wherein said borate compound includes calcium borate.

21. A method (70) as set forth in claim 3 including aluminia in said second composition (77).

22. A method (70) as set forth in claim 21 including zirconia in said second composition (77).

23. A method (70) as set forth in claim 22 including steatite in said second composition (77).

24. A method (70) as set forth in claim 23 including ferrous metal powder in said second composition (77).

25. A method (70) as set forth in claim 24 including nonferrous metal powder in said second composition (77).

26. A method (70) as set forth in claim 1 wherein said first composition (76) including between 49% to 99% of said metal powder (74) in relation to said ceramic powder (72) and said binder (78).

27. A method (70) as set forth in claim 1 wherein said composition (77) including between 49% to 89% of said ceramic powder (72) in relation to said metal powder (74) and said binder (78).

28. A method (70) as set forth in claim 1 wherein said first composition (76) including 99.9% of said metal powder (74) in relation to said binder (78).

29. A method (70) as set forth in claim 1 wherein said second composition (77) including 99.9% of said ceramic powder (72) in relation to said binder (78).

30. A method (70) as set forth in claim 3 wherein the step of debinding (92) said liner (12) includes heating said liner (12) at the temperature between about 300 to 450° C.

31. A method (70) as set forth in claim 7 wherein the step of debinding (98) said manifold (10) includes heating said manifold (10) at the temperature between about 300 to 450° C.

32. A method (70) as set forth in claim 3 wherein the step of sintering (94) said liner (12) includes heating said liner (12) between about 1400 to 1600° C.

33. A method (70) as set forth in claim 7 wherein the step of sintering (100) said manifold (10) includes heating said manifold (10) between about 1400 to 1500° C.

34. An exhaust manifold (10) comprising:

a liner (12) of a homogeneous and continuous material formed of a metal powder and a ceramic powder to define an inner surface (14) and manifold passages and an outer surface (16); and a shell (18) of another homogeneous and continuous material formed from extruded pellets of a metal powder bonded to a ceramic powder by a binder and disposed over said outer surface (16) of said liner (12).

35. An exhaust manifold (10) as set forth in claim 34 wherein said homogeneous and continuous material includes a binder to form said shell (18).

36. An exhaust manifold (10) as set forth in claim 35 wherein said binder includes water.

37. An exhaust manifold (10) as set forth in claim 36 wherein said binder includes an agar solution.

38. An exhaust manifold (10) as set forth in claim 37 wherein said binder includes a gel strength-enhancing agent.

39. An exhaust manifold (10) as set forth in claim 34 wherein said homogeneous and continuous material includes between 49% to 99% of said metal powder in relation to said ceramic powder and said binder.

40. An exhaust manifold (10) as set forth in claim 34 wherein said liner (12) comprises first (60) and second (62) halves defining said passages therebetween to allow a gas flow run through said exhaust manifold (10).

41. An exhaust manifold (10) as set forth in claim 34 wherein said second homogeneous and continuous material includes said binder to form said liner (12).

42. An exhaust manifold (10) as set forth in claim 41 wherein said second homogeneous and continuous material includes between 49% to 89% of said ceramic powder in relation to said metal powder and said binder.

43. An exhaust manifold (10) as set forth in claim 34 wherein said second homogeneous and continuous material includes 99.9% of said ceramic powder in relation to said binder.

44. An exhaust manifold (10) as set forth in claim 34 wherein said shell (18) and liner (12) define a housing (20) that includes a central portion (22) having inlet (24) and outlet (26) ends and side walls (28), (30).

45. An exhaust manifold (10) as set forth in claim 44 wherein said inlet end (24) of said central portion (22) includes an inlet flange (32) extending therefrom to mount said exhaust manifold (10) to a surface of an engine (34).

46. An exhaust manifold (10) as set forth in claim 45 wherein said inlet flange (32) includes at least one aperture (34) defined therewithin to receive a male connector (38) to engage said flange (32) with the surface of the engine (34).

47. An exhaust manifold (10) as set forth in claim 42 wherein said outlet end (26) of said central portion (22) includes outlet flange (40) extending therefrom to mount said exhaust manifold (10) to a catalytic converter (42).

48. An exhaust manifold (10) as set forth in claim 47 wherein said outlet flange (40) includes at least one aperture (44) defined therewithin to receive a male connector (46) to engage said outlet flange (40) with the catalytic converter (42).

49. An exhaust manifold (10) as set forth in claim 48 wherein said central portion (22) includes at least one outlet portion (48) outwardly extending from said side walls (28), (30) to a distal end (50) terminating into a flange (52).

50. An exhaust manifold (10) as set forth in claim 49 wherein said flange (52) includes at least one aperture (54) defined therewithin to receive said male connector (46) to engage said outlet portion (48) with the engine (34).

51. An exhaust manifold (10) as set forth in claim 50 wherein said distal end (50) includes a boss (56) extending outwardly therefrom including an aperture (58) to provide for additional connection of said manifold (10) within the engine (34).

* * * * *

UNITED STATES PATENT AND TRADEMARK OFFICE

CERTIFICATE OF CORRECTION

PATENT NO. : 6,933,056 B2
DATED : August 23, 2005
INVENTOR(S) : Boney A. Mathew

It is certified that error appears in the above-identified patent and that said Letters Patent is hereby corrected as shown below:

Column 7,
Line 13, delete “42” and insert therefore -- 46 --.

Signed and Sealed this

First Day of November, 2005

JON W. DUDAS
*Director of the United States Patent and Trademark Office*